United States Patent [19]

Marchionda

[11] 4,352,495

[45] Oct. 5, 1982

[54] TENNIS RACKET

[76] Inventor: Tony F. Marchionda, 708 Fifth St., Struthers, Ohio 44471

[21] Appl. No.: 232,719

[22] Filed: Feb. 9, 1981

[51] Int. Cl.[3] ..... A63B 49/02
[52] U.S. Cl. ..... 273/73 C
[58] Field of Search ..... 273/73 R, 73 C, 67 R, 273/129 R, 129 L, 326, 162 E

[56] References Cited

U.S. PATENT DOCUMENTS

| | | | |
|---|---|---|---|
| D. 216,138 | 11/1969 | Carignan | 273/162 E X |
| 2,142,527 | 1/1939 | Pool | 273/326 |
| 2,596,894 | 5/1952 | Frisch | 273/326 |
| 3,507,495 | 4/1970 | Tucker et al. | 273/326 |
| 3,702,702 | 11/1972 | Hoult | 273/326 |

FOREIGN PATENT DOCUMENTS

| | | | |
|---|---|---|---|
| 393738 | 11/1908 | France | 273/73 C |
| 601637 | 12/1925 | France | 273/73 C |
| 697218 | 10/1930 | France | 273/73 C |
| 18519 | of 1904 | United Kingdom | 273/73 C |
| 298247 | 10/1928 | United Kingdom | 273/73 C |

*Primary Examiner*—Anton O. Oechsle
*Attorney, Agent, or Firm*—Harpman & Harpman

[57] ABSTRACT

A tennis or like racket has a frame forming an oval head, the head forming frame being cross sectionally rectangular with a plurality of spaced apertures through which the strings are engaged, one side of the outer end of the oval shaped head being beveled to form an inclined surface relative to the longitudinal axis of the racket which enables a tennis or like ball to be scooped up with the racket by pushing or sliding the racket along the ground under the ball so as to move the ball onto the stringed portion of the racket.

2 Claims, 4 Drawing Figures

TENNIS RACKET

BACKGROUND OF THE INVENTION (1) Technical Field

This invention relates to tennis or similar rackets of the type having metal or wooden frames with typical ovaloid shaped head portions.

(2) Description of the Prior Art

Prior rackets may be seen in U.S. Pat. No. 3,507,495 and British Pat. No. 18,519.

In U.S. Pat. No. 3,507,495 a Lacrosse stick is shown wherein the frame member of the head portion is angled inwardly on one side toward the webbing of the head and adjacent its end.

In British Pat. No. 18,519 an improvement in tennis or similar rackets can be seen to include a V-shaped ridge on both front and back surfaces of the frame extending outwardly on the horizontal axis of the frame to reduce its air resistance when the racket is swung through the air.

In applicant's racket an end portion of the racket, normally the top end portion of the frame forming the head, has an inclined surface forming a ramp that a ball can easily roll upward thereon. The arrangement is such that the ball can be "picked" up with the racket. The construction of the prior art rackets does not permit such a function.

SUMMARY OF THE INVENTION

An improved tennis racket or the like having an ovaloid head with a portion thereof opposite the handle having an inclined surface extending transversely of the longitudinal axis of the racket and forming a large inclined ramp to guide and lift a tennis ball onto the racket when the racket is moved sharply in under the side of the ball.

DESCRIPTION OF THE PREFERRED EMBODIMENT

Figure 1:
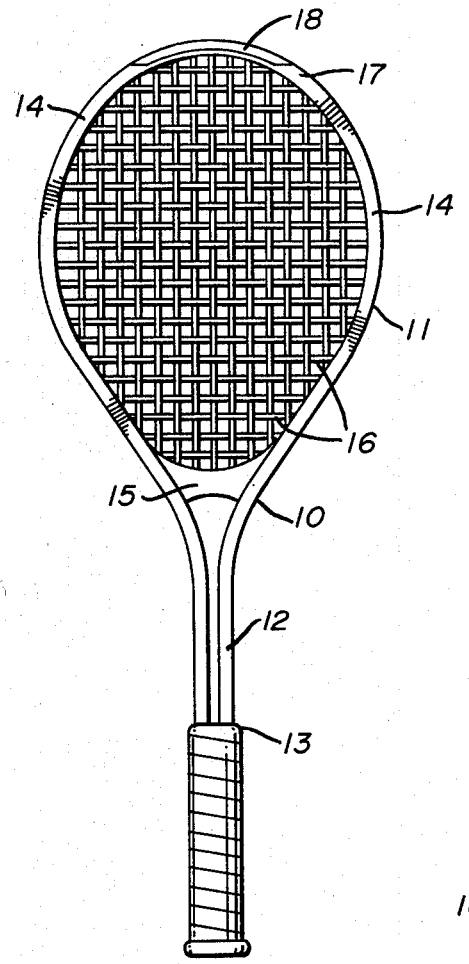
FIG. 1 is a plan view of a tennis racket incorporating the inclined frame portion.

By referring to the drawings and FIG. 1 in particular it will be seen that a tennis racket comprises a frame 10 having a generally ovaloid shaped head portion 11 of a known width terminating in a pair of closely spaced parallel extensions 12 which are held in position by a handle 13 which can be molded or plastic material and is preferably covered with a resilient continuous wrapping as customary in the art.

The ovaloid head portion 11 is defined by a pair of oppositely disposed curved portions 14 of the frame 10. The parallel extensions 12 and the curved portions 14 are preferably formed of a continuous cross sectionally rectangular shape such as an aluminum extrusion which may be hollow or may define a channel. The head portion has an outer side and an inner side. The ovaloid shape of the head portion 11 of the racket is completed by a throat 15 positioned between the curved portions 14. Crossed strings 16 are secured across the head portion 11 on its inner side between the curved portions 14 and the throat 15.

Figure 2:
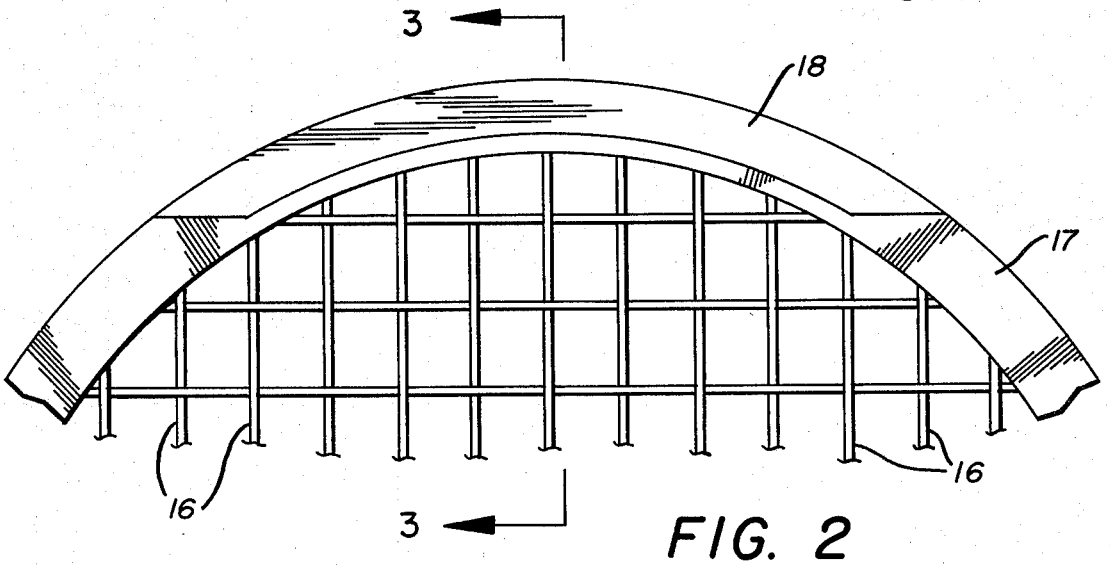
FIG. 2 is an enlarged plan view of a portion of the racket head showing the inclined frame.

Referring now to FIGS. 1 and 2 of the drawings, an enlarged top portion 17 of the frame 10 will be seen to have a tapered section 18 extending along the upper edge thereof with the taper 18 being on a uniform plane at an angle to the longitudinal axis of the racket so as to form an incline. The taper may be concave. As illustrated in these figures, tapered section 18 has a length substantially equal to half the width of the racket.

Figure 3:
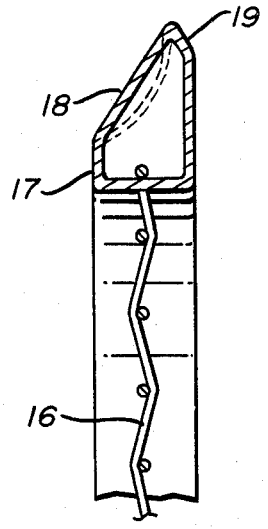
FIG. 3 is a cross sectional elevation on line 3—3 of FIG. 2.

In FIG. 3 of the drawings, the taperd section 18 of the upper end 17 of the frame 10 of the racket will be seen to extend across the majority of one side of the frame 10, the remainder of which is on a plane parallel with the longitudinal axis of the racket. It will be seen that a second tapered area 19 is formed on the other side of the top portion 17 of the racket and extends over a smaller area of the other side of the top portion 17 of the racket. The angle of inclination of both tapered areas 18 and 19 is substantially the same with respect to the longitudinal axis of the racket and is formed so that the taper 19 is generally parallel with the ground G as seen in FIG. 4 of the drawings when the racket is moved by a player along the ground so as to engage and pick up a ball B.

Figure 4:
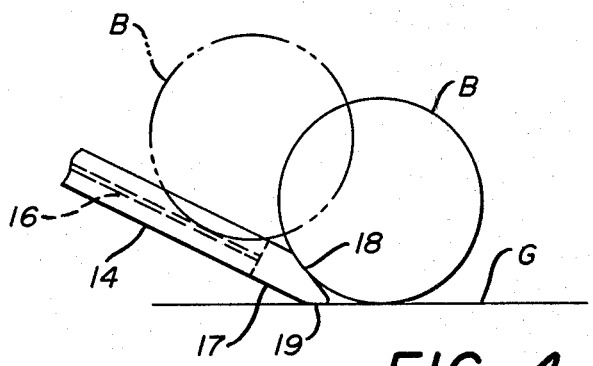
FIG. 4 is a side elevation of a portion of the racket engaging a tennis ball with solid lines showing the ball about to be moved and broken lines showing the ball moved onto the racket.

The angle of inclination of the tapered areas 18 and 19 may be varied in different rackets to match the reach of the player in relation to the length of the racket as its normally top end 17 rests on the ground G as seen in FIG. 4 of the drawings. In use the player pushes the racket along the ground G against the tennis ball B in a relatively quick motion forcing the ball B to roll up the tapered portion 18 onto the strings 16 where it is held by a configuration of the frame. The player can then easily pick up the racket and retrieve the ball therefrom. The side of the frame 10 of the racket is offset from the strings 16 sufficiently to prevent the ball B from rolling back down the tapered portion 18 and off the racket as best seen in the broken line illustration in FIG. 4 of the drawings.

It will thus be apparent to those skilled in the art that a tennis racket incorporating a novel and highly practical tapered end portion on the normally upper or outer end of the racket with respect to the handle has been disclosed which enables a player to scoop up a ball from the ground or a court floor and avoid stooping downwardly to pick up the ball as has heretofore been necessary.

Although but one embodiment of the present invention has been illustrated and described, it will be apparent to those skilled in the art that various changes and modifications may be made therein without departing from the spirit of the invention and having thus described my invention:

What I claim is:

1. In a tennis racket having a frame of a known thickness with an oval head portion having an outermost end and a handle in oppositely disposed relation thereto and stringing in said head portion, the frame in said head portion having an outer side and an inner side and spaced front and back walls extending therebetween, unequal oppositely disposed tapered areas formed in said front and back walls of said frame in said head portion in the outermost end thereof, the tapered areas joining one another in sharp angular relation and defining said outer side of said head portion in said outermost end so that the frame in the tapered area is thin and pointed at its outer side and of said known thickness at its inner side, said tapered area in said front wall being substantially greater than the tapered area in said back wall so as to form a substantially longer incline in said front wall for a ball rolling toward said racket and up said incline onto said stringing.

2. The improvement in a tennis racket set forth in claim 1 and wherein the tapered area in the front wall of said frame is arcuate and of a length substantially equal to half the known width of said racket.

* * * * *